US009020410B2

(12) United States Patent
Hasegawa

(10) Patent No.: US 9,020,410 B2
(45) Date of Patent: Apr. 28, 2015

(54) IMAGE HEATING APPARATUS

(71) Applicant: Canon Kabushiki Kaisha, Tokyo (JP)

(72) Inventor: Takuya Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/178,557

(22) Filed: Feb. 12, 2014

(65) Prior Publication Data

US 2014/0224623 A1 Aug. 14, 2014

(30) Foreign Application Priority Data

Feb. 13, 2013 (JP) ..... 2013-025456

(51) Int. Cl.
*G03G 15/20* (2006.01)

(52) U.S. Cl.
CPC .... *G03G 15/2017* (2013.01); *G03G 2215/2019* (2013.01)

(58) Field of Classification Search
CPC ..... G03G 15/2017; G03G 15/2053; G03G 2215/2019
USPC ..... 399/329, 330
See application file for complete search history.

(56) References Cited

U.S. PATENT DOCUMENTS 7,711,306 B2 5/2010 Kagawa
2006/0245796 A1* 11/2006 Wu et al. ..... 399/328
2007/0189817 A1* 8/2007 Kagawa ..... 399/328
2013/0209145 A1 8/2013 Hasegawa
2014/0086647 A1 3/2014 Hasegawa
2014/0093287 A1 4/2014 Hasegawa
2014/0153947 A1 6/2014 Hasegawa
2014/0153981 A1 6/2014 Hasegawa

FOREIGN PATENT DOCUMENTS

JP 2007-212896 A 8/2007

OTHER PUBLICATIONS

U.S. Appl. No. 14/178,542 to Takuya Hasegawa, filed Feb. 12, 2014, Status: Pending.

* cited by examiner

*Primary Examiner* — Gregory H Curran
(74) *Attorney, Agent, or Firm* — Fitzpatrick, Cella, Harper & Scinto

(57) ABSTRACT

An image heating apparatus includes first and second rotatable members for forming a nip for heating therein a toner image on a sheet; an endless belt for contacting an outer surface of the first rotatable member and heat the first rotatable member; first and second rollers provided inside the endless belt and to rotatably support the endless belt; first and second bearings for rotatably supporting the first and second rollers; an elastic member contactable to the first bearing and to the second bearing and for urging the first roller and the second roller in directions away from each other; and a preventing member for preventing the elastic member from moving in directions of expansion and contraction thereof when the elastic member is out of contact with the first bearing and the second bearing.

18 Claims, 12 Drawing Sheets

(a)

(b)

(a)

(b)

(a)

(b)

IMAGE HEATING APPARATUS

FIELD OF THE INVENTION AND RELATED ART

The present invention relates to an image heating apparatus which heats a toner image on a sheet of a recording medium.

It has been a common practice to equip an electrophotographic image forming apparatus with a fixing device (image heating apparatus) which applies heat and pressure to an unfixed toner image on a sheet of a recording medium to fix the toner image to the sheet.

An attempt to increase a fixing device, such as the one described above, in process speed is problematic in that it is likely to make it difficult to keep the temperature of the fixing member of the fixing device at a proper level for fixation. This problem can be dealt with, by providing a fixing device with a heating means for externally heating the fixing member (rotational member). More concretely, there is disclosed in Japanese Laid-open Patent Application 2007-212896, a fixing device equipped with an external heating belt (endless belt) which heats the fixing member by being placed in contact with the peripheral surface of the fixing member.

The fixing device disclosed in Japanese Laid-open Patent Application 2007-212896 is structured so that one of the two rollers by which the external heating belt of the external heating belt unit is suspended and kept tensioned is movable in the direction perpendicular to its rotational axis, and is kept under the pressure generated by a coil spring (elastic member) in the direction to provide the external heating belt with a preset amount of tension. Further, the fixing device is structured so that one end of the coil spring remains in contact with the bearing for the movable roller, whereas the other end of the coil spring is held to the external heating belt unit.

In a case where an external heat belt unit is structured so that the two ends of its coil spring are placed into contact with the its rollers (or bearing of each roller), one for one, by which its external heating belt is suspended and kept tensioned, in order to increase the distance between the axial line of one the two rollers, and the axial line of the other roller, it is feared that the following phenomenon might occur.

That is, if the bearings for the two rollers by which the belt suspended and kept tensioned are attached to the bearing holding members of the external heating unit while the coil spring remains unregulated in position, it is feared that one of the ends of the coil spring will interfere with the bearing of the corresponding roller, and therefore, the coil spring will be damaged.

SUMMARY OF THE INVENTION

According to an aspect of the present invention, there is provided an image heating apparatus comprising: first and second rotatable members configured and positioned to form a nip for heating therein a toner image on a sheet; an endless belt configured to contact an outer surface of the first rotatable member and heat the first rotatable member; first and second rollers provided inside the endless belt and to rotatably support the endless belt; first and second bearings configured to rotatably support the first and second rollers; an elastic member contactable to the first bearing and to the second bearing and configured and positioned to urge the first roller and the second roller in directions away from each other; and a preventing member configured and positioned to prevent the elastic member from moving in directions of expansion and contraction thereof when the elastic member is out of contact with the first bearing and the second bearing.

According to another aspect of the present invention, there is provided an image heating apparatus comprising: first and second rotatable members configured and positioned to form a nip for heating therein a toner image on a sheet; an endless belt configured to contact an outer surface of the first rotatable member and heat the first rotatable member; first and second rollers provided inside the endless belt and to rotatably support the endless belt; first and second bearings configured to rotatably support the first and second rollers; a holder configured to hold the first bearing and the second bearing; a coil spring configured and positioned to urge the first roller and said second roller in directions away from each other, the coil spring having one end portion, with respect to expansion and contracting directions, which is contactable with the first bearing, and the other end portion which is contactable with the second bearing; and a fixing member configured to fix, to the holder, a portion which is between the one end portion and the other end portion.

Further features of the present invention will become apparent from the following description of exemplary embodiments (with reference to the attached drawings).

DESCRIPTION OF THE PREFERRED EMBODIMENTS

Hereinafter, the embodiments of the present invention are described in detail with reference to appended drawings.

<Image Forming Apparatus>

Figure 1:
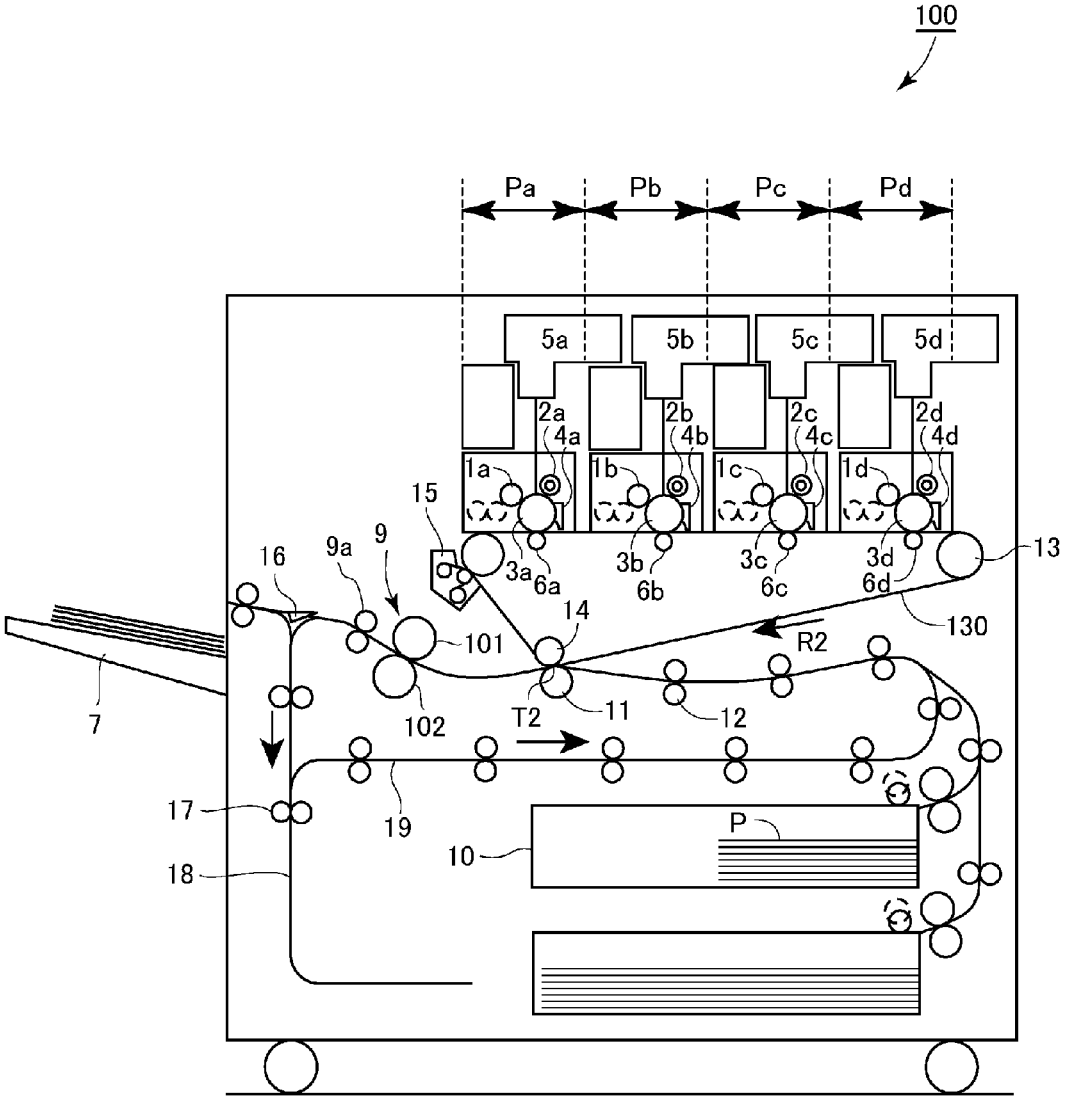
FIG. 1 is a schematic drawing for illustrating the structure of a typical image forming apparatus to which the present invention is applicable.

FIG. 1 is a schematic drawing for illustrating the structure of a typical image forming apparatus to which the present invention is applicable. Referring to FIG. 1, an image forming apparatus 100 is a full-color printer of the tandem-type, and also, of the intermediary transfer type. It has image formation stations Pa, Pb, Pc and Pd for forming yellow, magenta, cyan, and black toner images, respectively, and an intermediary transfer belt 130. The four image formation stations are aligned in parallel (tandem) along the intermediary transfer belt 130.

In the image formation station Pa, a yellow toner image is formed on a photosensitive drum 3*a*, and is transferred (primary transfer) onto the intermediary transfer belt 130. In the image formation station Pb, a magenta toner image is formed, and is transferred (primary transfer) onto the intermediary transfer belt 130. In the image formation stations Pc and Pd, cyan and black toner images, respectively, are formed, and are transferred onto the intermediary transfer belt 130. That is, the yellow, magenta, cyan, and black toner images are sequentially transferred (primary transfer) onto the intermediary transfer belt 130.

Sheets P of recording medium in a recording medium cassette 10 are moved out of the cassette 10 one by one, and each sheet P is conveyed to a pair of registration rollers 12, at which the sheet P is kept on standby. Then, the registration rollers 12 convey the sheet P to the secondary transfer station T2, with such a timing that the sheet P reaches the secondary transfer station T2 at the same time as the four toner images, different in color, on the intermediary transfer belt 130. Then, while the sheet P is conveyed through the secondary transfer station T2, the toner images are transferred (secondary transfer) from the intermediary transfer belt 130 onto the sheet P. Then, the sheet P is conveyed to the fixing device 9, in which the sheet P and the toner images thereon are subjected to heat and pressure, whereby the toner images are fixed to the sheet P. Then, the sheet P is discharged into the external delivery tray 7 of the image forming apparatus 100.

The image formation stations Pa, Pb, Pc and Pd are practically the same in structure, although they are different in the color of the toner used by their developing devices 1*a*, 1*b*, 1*c* and 1*d*, respectively. Thus, only the image formation Pa is described, in order not to repeat the same descriptions.

The image formation station Pa has the photosensitive drum 3*a*, a charge roller 2*a*, an exposing device 5*a*, a developing device 1*a*, a primary transfer roller 6*a*, and a drum cleaning device 4*a*. The charge roller 2*a*, the exposing device 5*a*, the developing device 1*a*, the primary transfer roller 6*a*, and the drum cleaning device 4*a* are disposed in the adjacencies of the peripheral surface of the photosensitive drum 3*a*, in the listed order. The photosensitive drum 3*a* is made up of an aluminum cylinder, and a photosensitive layer formed on the peripheral surface of the aluminum cylinder.

The charge roller 2*a* uniformly charges the peripheral surface of the photosensitive drum 3*a* to a preset potential level. The exposing device 5*a* writes an electrostatic image on the peripheral surface of the photosensitive drum 3*a*, by scanning the uniformly charge portion of the peripheral surface of the photosensitive drum 3*a*, with a beam of laser light which it emits. The primary transfer roller 6*a* transfers (primary transfer) the toner images on the peripheral surface of the photosensitive drum 3*a* onto the intermediary transfer belt 130, by being given voltage.

The drum cleaning device 4*a* is provided with a cleaning blade. It recovers the transfer residual toner, which is the toner having escaped from the primary transfer process, and therefore, remains adhered to the peripheral surface of the photosensitive drum 3*a* after the primary transfer, by causing the cleaning blade to scrape the peripheral surface of the photosensitive drum 3*a*. The belt cleaning device 15 recovers the transfer residual toner, which is the toner having escaped from the process carried out in the secondary transfer station T2 to transfer the toner on the intermediary transfer belt 130 onto the sheet P of the recording medium, and therefore, remaining on the intermediary transfer belt 130 after the secondary transfer.

Embodiment 1

Figure 2:
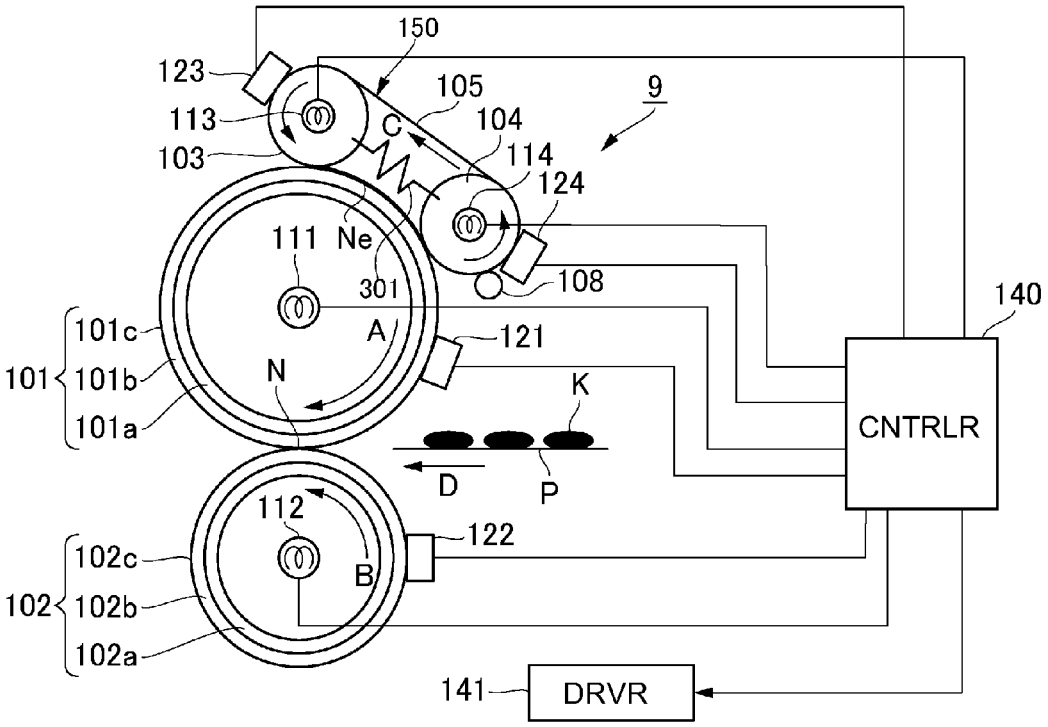
FIG. 2 is a schematic drawing for illustrating the structure of the fixing device in the first embodiment of the present invention.
Figure 3:
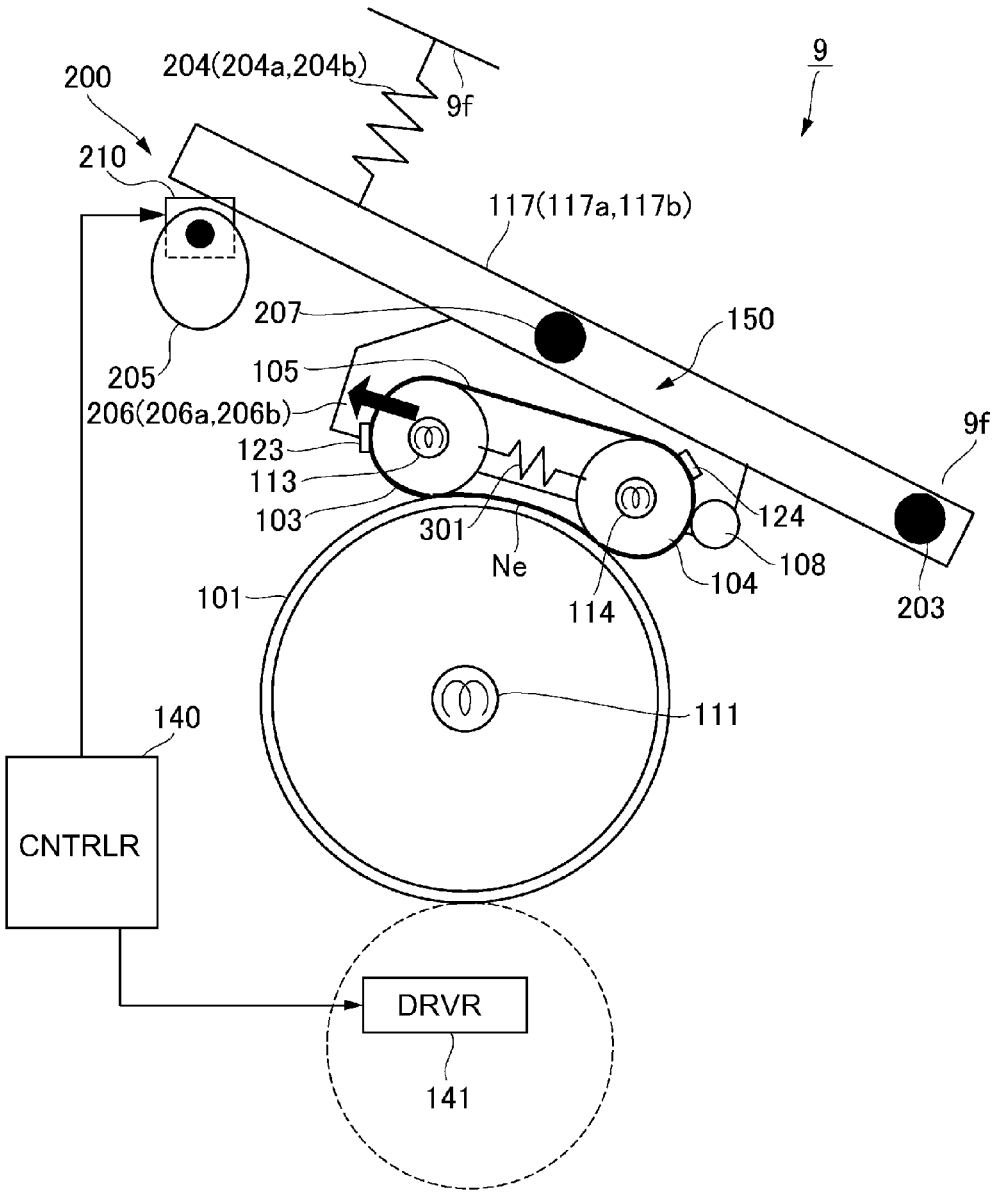
FIG. 3 is a schematic drawing for illustrating the engaging-disengaging mechanism, in the first embodiment, for placing the external heating belt in contact with, or separating the external heating belt from, the fixing roller.

Referring to FIG. 2, a fixation roller 101, which is an example of a rotational member, rotates in contact with a sheet P of the recording medium. The fixation roller 101 has: a metallic core 101*a*, which is an example of metallic roller; an elastic layer 101*b* which covers the peripheral surface of the metallic core 101*a*; and a halogen heater 111, which is an example of heating means for heating the metallic core 101*a*. An external heat belt 105, which is an example of member in the form of a belt is for adjusting the fixation roller 101 in thermal characteristic. It rotates in contact with the fixation roller 101. Referring to FIG. 3, an engaging-disengaging mechanism 200, which is an example of mechanism for placing the external heat belt 105 in contact with the fixation roller 101, or separating the external heating belt 105 from the fixation roller 101, moves the bearing holding member 206 in the direction to separate the external heat belt 105 from the fixation roller 101, or place the external heat belt 105 in contact with the fixation roller 101.

The first heat roller 103, which is an example of a first roller, is one of the two rollers by which the external heat belt 105 is suspended and kept stretched. The halogen heater 113, which is an example of a first roller heating means, heats the first heat roller 103. The second heat roller 104, which is an example of the second roller, is on the downstream side of the first heat roller 103 in terms of the rotational direction of the fixation roller 101, and suspends and keeps stretched the external heat belt 105. The halogen heater 14, which is an example of second roller heating means, heats the second heat roller 104.

Figure 5:
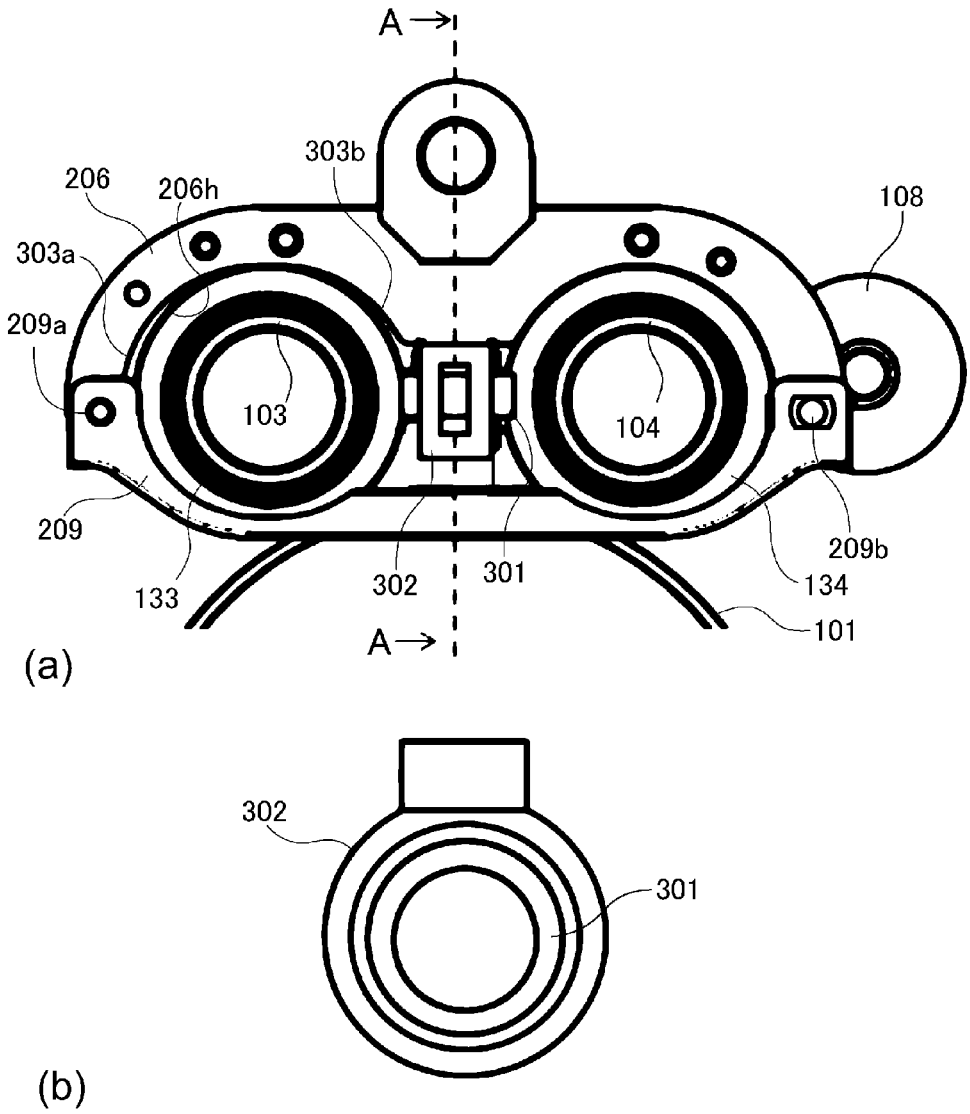
FIGS. 5(*a*) and 5(*b*) are schematic drawings for illustrating the structure of the bearing holding member.

Referring to FIGS. 5(*a*) and 5(*b*), a bearing 133, which is an example of the first bearing, rotatably supports one of the lengthwise end portions of the first heat roller 103. A bearing 134, which is an example of the second bearing, rotatably supports one of the lengthwise end portions of the second heat roller 104. A bearing holding member 206, which is an example of bearing holder, holds both the bearings 133 and 134 in such a manner that the distance between the axial line of the first heat roller 103 and the axial line of the second heat roller 104 can be changed. The bearing holding member 206, which is also an example of a frame, is provided with a pair of recesses in which the bearings 133 and 134 are removably held, one for one. A heat roller fixing member, which is an example of fixing member, is fixed to the bearing holding member 206, and retains the bearings 133 and 134 in the recesses, one for one. The first recess of the bearing holding member 206 loosely holds the bearing 133. The second recess of the bearing holding member 206 tightly holds the bearing 134. Therefore, the distance by which the bearing 133 is moved in the first recess in the direction to change the distance between the axial line of the bearing 133, and the axial line of the second bearing 134 is greater than the distance by which the bearing 134 is moved in the direction to change the distance between the axial line of the bearing 133, and the axial line of the second bearing 134.

The pressing member 301 which, is an example of an elastic member, is disposed between the bearings 133 and 134. It presses the bearings 133 and 134 in the direction to increase the distance between the axial line of the bearing 133 and the axial line of the bearing 134. The pressing member 301 is attached to the bearing holding member 206. Therefore, it remains attached to the bearing holding member 206 even after the removal of the bearings 133 and 134 from the bearing holding member 206.

A cylindrical wall 302, which is an example of cylindrical member, is attached to the bearing holding member 206. It holds the pressing member 301 in such a manner that the pressing member 301 is allowed to move in the direction in which the pressing member 301 extends, or is compressible. The pressing member 301 is a coil spring. It is disposed so that one of its lengthwise ends remains in contact with the bearing 133, and the other remains in contact with the bearing 134. An elastic member 303, which is an example of regulating member (preventing member; fixing member), holds the pressing member 301 to the cylindrical wall 302, by the center portion of the pressing member 301, in terms of the extension-compression direction of the pressing member, to regulate the pressing member 301 in the movement within the cylindrical wall 302 which is an example of cylindrical member.

(Fixing Device)

FIG. 2 is a schematic drawing for illustrating the structure of the fixing device in the first embodiment of the present invention. Referring to FIG. 2, the fixing device 9 has the fixation roller 101 and the pressure roller 102. It is structured so that the pressure roller 102 is pressed upon the fixation roller 101 to form a nip N, through which is conveyed a sheet P of a recording medium, across which an unfixed toner image K is borne, remaining pinched by the fixation roller 101 and the pressure roller 102, so that the toner, of which the unfixed toner image K is formed, is melted and becomes fixed to the surface of the sheet P.

The amount of heat necessary to fix an unfixed toner image to a sheet P of a recording medium (cardstock, for example) that is large in basis weight is substantially greater than the amount of heat necessary to fix an unfixed toner image to a sheet P of a recording medium (thin paper, for example) that is small in basis weight. Therefore, the amount of heat robbed from the fixation roller 101 when an unfixed toner image is fixed to a sheet of a recording medium that is large in basis weight, is greater than when an unfixed toner image is fixed to a sheet P of a recording medium that is small in basis weight. Therefore, when an unfixed toner image is fixed to a sheet P of a recording medium having a large basis weight, the amount of decrease in the surface temperature of the fixation roller 101 is greater than when an unfixed toner image is fixed to a sheet P of a recording medium having a small basis weight. As the surface temperature of the fixation roller 101 decreases, it is likely for unsatisfactory fixation to occur. Therefore, in order to prevent a decrease in productivity in the fixing device 9 when a sheet P of a recording medium having a large basis weight is used as the recording medium, it is necessary to improve the heating performance of the fixing device 9. The fixation roller 101 is made up of a metallic cylindrical core, and an elastic layer formed on the peripheral surface of the metallic core, of a heat resistant substance such as silicon rubber, fluorinated rubber, etc. Therefore, one of the causes of the surface temperature reduction of the fixation roller 101 is that the metallic core and elastic layer are low in thermal conductivity. That is, the metallic core and the elastic layer function as a heat shield, and therefore, it is difficult for the heat generated by a halogen heater in the fixation roller 101 to be transmitted to the surface of the fixation roller 101.

The reduction in the surface temperature of a fixation roller (101) that does not have an elastic layer is smaller than the reduction in the surface temperature of the fixation roller 101 with an elastic layer, by an amount equivalent to the amount of heat from the halogen heater 111 blocked by the elastic layer. However, even in the case of a fixation roller that does not have an elastic layer, the thicker the metallic core, the greater the amount of heat from the halogen heater 111 that is blocked by the metallic core, and therefore, the surface temperature is reduced by a substantial amount. Further, in the case of a fixation roller having no elastic layer, if a sheet P of a recording medium to be used for image formation is rough in surface texture, it is difficult for the peripheral surface of the fixation roller to come into contact with the toner in the recesses of the sheet P of the recording medium, and therefore, it is likely for the toner in the recesses to fail to be properly fixed. In particular, in an image forming operation for forming a multicolor image, the toner has to be uniformly melted across the entirety of the multicolor image. Thus, if the toner is not uniformly melted across the entirety of the multicolor image, the image becomes non-uniform in fixation and gloss, and also, the image suffers from color deviation. In other words, the image quality of the multicolor image decreases. Therefore, from the standpoint of enabling the fixing device 9 to deal with various recording media different in basis weight and/or surface texture, in order to prevent a decrease in image quality by the fixing device 9 when an image is formed on a sheet P of a recording medium which is rough in surface texture, it is desired that the fixation roller 101 is provided with the elastic layer.

The fixation roller 101 has: the metallic core 101*a*; an elastic layer 101*b* formed across the entirety of the peripheral surface of the metallic core 101*a*; and a parting layer 101*c* formed across the entirety of the outward surface of the elastic layer 101*b*. The fixation roller 101 is driven by a driving mechanism 141 which includes an unshown gear train. It is rotated in the direction indicated by an arrow mark A in FIG. 2, at a process speed of 300 mm/sec.

The pressure roller 102 has: a metallic core 102*a*; an elastic layer 102*b* formed of silicon rubber, across the entirety of the peripheral surface of the metallic core 102*a*; and a parting layer 102*c* formed across the entirety of the outward surface of the elastic layer 102*b*. It is driven by the driving system 141, and rotates in the direction indicated by an arrow mark B in FIG. 2. The pressure roller 102 is placed in contact with, or separated from, the fixation roller 101, by being driven by an unshown pressure applying mechanism which employs an eccentric cam. The unshown pressure applying mechanism applies a preset amount of pressure to the pressure roller 102 to press the fixation roller 101 upon the fixation roller, forming the nip N between the fixation roller 101 and the pressure roller 102.

The halogen heater 111 is non-rotationally disposed in the hollow of the metallic core 101*a* of the fixation roller 101. A thermistor 121 is disposed in contact with the fixation roller 101 to detect the surface temperature of the fixation roller 101. A control section 140 turns on or off the halogen heater 111 in response to the surface temperature of the fixation roller 101 detected by the thermistor 121, in order to keep the surface temperature of the fixation roller 101 at a preset target level, which is set according to recoding medium type.

The halogen heater 112 is non-rotationally disposed in the hollow of the metallic core 102*a* of the pressure roller 102. A thermistor 122 is placed in contact with the pressure roller 102 to detect the surface temperature of the pressure roller 102. The control section 140 turns on or off the halogen heater 112 in response to the surface temperature of the pressure roller 102 detected by the thermistor 122, in order to keep the surface temperature of the pressure roller 102 at a preset target level.

(External Heat Belt)

Referring to FIG. 2, the external heat belt 105 is placed in contact with the peripheral surface of the fixation roller 101, forming thereby a nip Ne, in which it externally heats the fixation roller 101. The external heat belt 105 increases the first and second heat rollers 103 and 104 in the efficiency with which the rollers 103 and 104 can heat the fixation roller 101, by increasing in size the area of indirect contact between the first and second rollers 103 and 104 and the fixation roller 101, through which heat is conducted from the two rollers 103 and 104 to the fixation roller 101. The substrative layer of the external heat belt 105 is made of a metallic substance, such as stainless steel and nickel, or a resinous substance such as polyimide. In order to prevent toner from adhering to the substrative layer, the surface of the substrative layer is provided with a heat resistant slippery layer formed of fluorinated resin. The external heat belt 105 is driven by the friction which occurs between the peripheral surface of the fixation roller 101 and external heat belt 105 as the fixation roller 101 is rotated; it is rotated by the rotation of the fixation roller 101 in the direction indicated by an arrow mark C in FIG. 2.

The first heat roller 103 is formed of a metallic substance, such as aluminum, iron, stainless steel, etc., which is high in thermal conductivity. There is stationarily disposed a halogen heater 113, in the hollow of the first heat roller 103, in such a manner that the axial line of the halogen heater 113 coincides with the rotational axis of the first heat roller 103. A thermistor 123 is placed in contact with the portion of the external heat belt 105, which is supported by the first heat roller 103, and detects the temperature of the external heat belt 105. The control section 140 turns on or off the halogen heater 113 in response to the temperature of the external heat belt 105 detected by the thermistor 123, in order to keep the temperature of the first heat roller 103 at a preset target level.

The second heat roller 104 is formed of a metallic substance, such as aluminum, iron, stainless steel, etc., which is high in thermal conductivity. There is stationarily disposed a halogen heater 114, in the hollow of the second heat roller 104, in such a manner that the axial line of the halogen heater 114 coincides with the rotational axis of the second heat roller 104. A thermistor 124 is placed in contact with the portion of the external heat belt 105, which is supported by the first heat roller 104, and detects the temperature of the external heat belt 105. The control section 140 turns on or off the halogen heater 114 in response to the temperature of the external heat belt 105 detected by the thermistor 124, in order to keep the temperature of the first heat roller 104 at a preset target level.

The target levels for the temperature control of the first and second heat rollers 103 and 104 are set higher than the target level for the temperature control of the fixation roller 101. Because the surface temperature of the first heat roller 103 and the surface temperature of the second heat roller 104 are kept higher than the surface temperature of the fixation roller 101, heat is efficiently supplied to the fixation roller, as the fixation roller 101 decreases in surface temperature. More concretely, in an image forming operation in which sheets of cardstock or the like are continuously conveyed, the target temperature level for the fixation roller 101 is set to 165° C., whereas the target temperature level for the first heat roller 103, and that for the second heat roller 104, are set higher by 75° C. than that for the fixation roller 101.

The surface layer of the external heat belt 105 is soiled by adhesive contaminants such as toner particles, paper dust, and the like which offset to the external heat belt 105 from a sheet P of the recording medium. The cleaning roller 108 has a surface layer formed of silicon rubber, and adheres the toner particles, paper dust, and the like on the surface layer of the external heat belt 105, to its surface layer. The cleaning roller 104 is kept pressed upon the external heat belt 105 by a preset amount of pressure. It cleans the surface of the external heat belt 105 by being rotated by the rotation of the external heat belt 105.

(Roller Support Mechanism)

Figure 4:
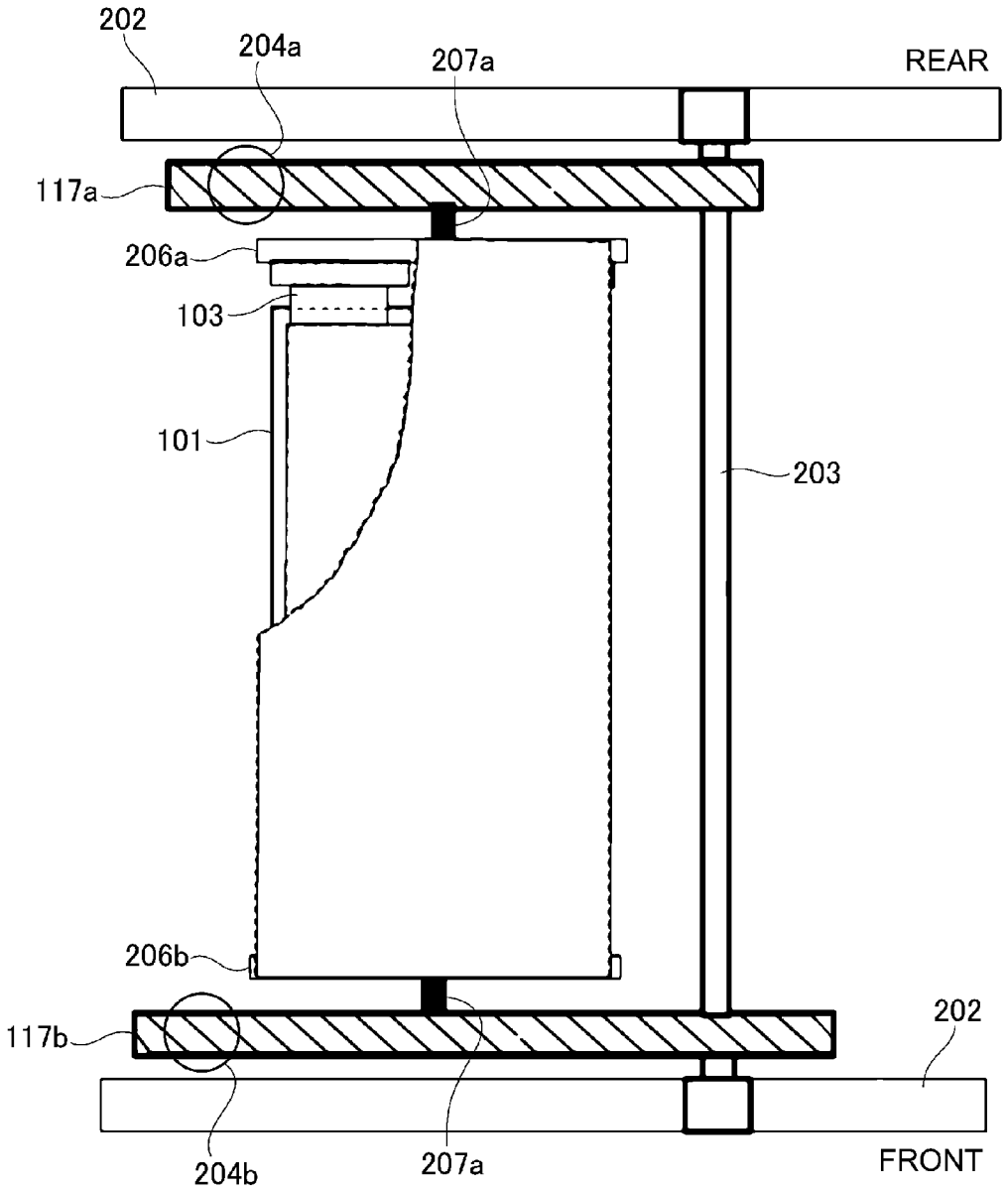
FIG. 4 is a plan view of the external heating unit.

FIG. 3 is a schematic drawing for illustrating the disengaging-engaging mechanism for placing the external heat belt 105 in contact with the fixation roller 101, or separating the external heat belt 105 from the fixation roller 101. FIG. 4 is a plan view of the external heating unit 150.

Referring to FIG. 3, the external heating unit 150 is structured so that the external heat belt 105 is suspended and kept stretched by the first and second heat rollers 103 and 104, in such a manner that the external heat belt 105 is rotated by the rotation of the fixation roller 101.

The external heat belt 105 can be placed in contact with, or separated from, the fixation roller 101 by the engaging-disengaging mechanism 200. The mechanism 200 doubles as the mechanism for pressing the first and second heat rollers 103 and 104 against the fixation roller 101 with the placement of the external heat belt 105 between the two heat rollers 103 and 104 and the fixation roller 101. A pressure application arm 117 is pivotally movable relative to the frame 9*f* of the fixing device 9, about a pivot 203, by which the pressure application arm 117 is supported.

There is disposed a compression spring 204 between the lengthwise opposite end portion of the pressure application arm 117 from the pivot 203, and the frame 9*f* of the fixing device 9. Thus, the compression spring 204 presses downward the opposite end of the pressure application arm 117 from the pivot 203, pressing thereby the first and second heat rollers 103 and 104 toward the fixation roller 101. While the first and second heat rollers 103 and 104 are remaining pressed against the fixation roller 101, with the presence of the external heat belt 105 between the two rollers 103 and 104 and the fixation roller 101, the overall amount of pressure generated by the compression spring 204 is 392 N (roughly 40 kgf).

A pressure removal cam 205 is placed in contact with, or separated from, the bottom surface of the tip portion of the pressure application arm 117. The control section 140 controls a motor 210 to rotate the pressure removal cam 205 to pivotally move the pressure application arm 117 so that the tip portion of the pressure application arm 117 moves upward or downward. As the pressure removal cam 205 is separated from the pressure application arm 117, the compression spring 204 is allowed to move downward the tip portion of the pressure application arm 117, and therefore, the external heat belt 105 is pressed upon the fixation roller 101. As the pressure removal cam 205 moves the pressure application arm 117 upward while compressing the compression spring 204, the external heat belt 105 is separated from the fixation roller 101.

(Engaging-Disengaging Mechanism)

Referring to FIG. 2, it is desired that when the fixing device 9 is on standby prior to the starting of the recording medium conveyance, the external heat belt 105 remains separated from the fixation roller 101. If the external heat belt 105 is in contact with the fixation roller 101 while the fixing device 9 is on standby prior to the starting of the recording medium conveyance, the portion of the peripheral surface of the fixation roller 101, which is in contact with the external heat belt 105, is heated by both the halogen heater 111 and external heat belt 105, and therefore, reaches the preset target temperature level before the rest of the peripheral surface of the fixation belt 101 reaches the target level. Thus, the halogen lamp 11 is turned off, causing thereby the fixation roller 101 to reduce in the internal temperature. If the recording conveyance is started in this condition, the surface temperature of the fixation roller 101 rapidly decreases as soon as the recording medium begins to be conveyed. Therefore, it is likely for fixation failure to occur. This is why it is necessary for the fixing device 9 to be equipped with the engaging-disengaging mechanism 200 for placing the external heat belt 105 in contact with, or separated from the fixation roller 101.

Next, referring to FIG. 3, the fixing device 9 is structured so that the external heat belt 105 can be placed in contact with, or separated from, the fixation roller 101. The fixing device 9 is equipped with the external heating unit 150, which is disposed in the adjacencies of the peripheral surface of the fixation roller 101. The external heating unit 150 has the first and second heat rollers 103 and 104, and external heat belt 105. It is structured so that the external heat belt 105 is suspended and kept stretched by the two heat rollers 103 and 104. The fixing device 9 has also a pair of compression springs 204*a* and 204*b*, which generate a preset amount of pressure for pressing the external heating unit 150 toward the fixation roller 101. Thus, the external heat belt 105 is kept in contact with the fixation roller 101. The engaging-disengaging mechanism 200 moves the external heating unit 150 upward to separate the external heat belt 105 from the fixation roller 101, or allows the external heating unit 150 to move downward to allow the external heat belt 105 to be kept in contact with the fixation roller 101.

Next, referring to FIG. 4, the bearing holding member 206*a* rotatably supports the first and second heat rollers 103 and 104, by their rear end portion. It is rotatably supported by the axle 207*a* in such a manner that it can be moved relative to the pressure application arm 117*a*. The bearing holding member 206*b* rotatably supports the first and second heat rollers 103 and 104 by their front end portion. It is pivotally supported by the axle 207*b* in such a manner that it can be pivotally moved relative to the pressure application arm 117*b*.

There is disposed a shaft 203 between the pair of lateral plates of the frame of the fixing device 9. The pressure application arm 117*a* is supported by the shaft 203 so that it can be rotationally moved about the shaft 203. It is under the pressure from the compression spring 204*a*, being pressed toward the fixation roller 101. The pressure application arm 117*b* is supported by the shaft 203 in such a manner that it is rotationally moved about the shaft 203. It is under the pressure generated by the compression spring 204*b*, being therefore kept pressed toward the fixation roller 101.

(Control of Engaging-Disengaging Mechanism)

The image forming apparatus is required to be high in productivity (print output count per unit length of time) even when such a recording medium as a sheet of cardstock or the like, which is large in basis weight (weight per unit area), is used for image formation. In order to keep the image forming apparatus 100 high in productivity even when the recording medium used for an image forming operation is large in basis weight, the fixing device 9 of the image forming apparatus has to be enabled to remain high in heating performance even when the recording medium used for the image forming operation is large in basis weight. The amount of heat absorbed by a recording medium large in basis weight from the fixation roller 101 is larger than the amount of heat absorbed by ordinary paper from the fixation roller 101. Therefore, the amount of heat which the former require for fixation is greater than that for the latter.

Referring to FIG. 3, when the fixing device 9 is kept on standby for the next job, its external heat belt 105 is kept separated from its fixation roller 101. As an image formation job is sent to the image forming apparatus 100, various preparatory operations are started by various devices in the image forming apparatus 100. One of the preparatory operations is the warm-up operation started by the fixing device 9. As the fixation roller 101, the pressure roller 102, the first heat roller 103, and the second heat roller 104 reach their target temperature level in the warm-up operation, the external heat belt 105 is pressed upon the fixation roller 101. Then, the image formation job is started. As the image formation job is completed, the external heat belt 105 is separated from the fixation roller 101, and then, it is kept separated from the fixation roller 101 until the next image formation job is started.

The control section 140 controls the motor 210 to rotate the pressure removal cam 205. As the pressure removal cam 205 is rotated, the pressure application arms 117*a* and 117*b* are moved upward or downward, causing thereby the external heat belt 105 to be separated from the fixation roller 101, or allow the external heat belt 105 to be placed in contact with the fixation roller 101.

(Bearing Holding Member)

FIGS. 5(*a*) and 5(*b*) are schematic drawings for illustrating the structure of the bearing holding member. Referring to FIG. 2, in the first embodiment, there is disposed the pressing member 301 between the first and second heat rollers 103 and 104. The pressing member 301 generates such a force that acts to increase the distance between the first and second heat rollers 103 and 104.

Referring to FIGS. 5(*a*) and 5(*b*), the bearing 133 rotationally bears the first heat roller 103 by one of the lengthwise ends of the shaft of the first heat roller 103. It is loosely held to the bearing holding member 206 by a bearing cover 209 which is for holding the bearing 133 to the bearing holding member 206. That is, the bearing 133 is sandwiched by the bearing holding member 206 and the bearing cover 209. The bearing 134 rotationally bears the second heat roller 104 by one of the lengthwise ends of the shaft of the second heat roller 104. It is tightly held to the bearing holding member 206 by the bearing cover 209 which is for holding the bearing 134 to the bearing holding member 206. That is, the bearing 134 is tightly sandwiched by the bearing holding member 206 and the bearing cover 209.

Also referring to FIGS. 5(*a*) and 5(*b*), the recess 206*h* of the bearing holding member 206 is shaped so that its cross-section looks like a half of an ellipse, the long axis of which is greater than the diameter of the bearing 133. Therefore, when the first heat roller 103 is in contact with the fixation roller 101, there are gaps 303*a* and 303*b* between the bearing 133 of the first heat roller 103, and the bearing holding member 206, in terms the horizontal direction. The bearing 134 of the second heat roller 104 is tightly held to the bearing holding member 206, that is, with no gap between the bearing 134 and bearing holding member 206.

The bearing holding member 206 is provided with a shaft 209*a*. The bearing cover 209 is supported by one of its lengthwise ends, by a shaft 209*a* so that it can be rotatably moved about the shaft 209*a* to reduce or widen the gap between itself and the bearing holding member 206. The other end of the bearing cover 209 is provided with an elongated hole. The corresponding end of the bearing holding member 206 is provided with a pin 209*b*, which is fitted into the elongated hole of the bearing cover 209 to hold the bearing cover 209 to the bearing holding member 206. Thus, the bearing cover 209 can be pivotally moved about the shaft 209*a* to allow the bearings 133 and 134 to be downwardly moved out of the bearing holding member 206.

In other words, the fixing device 9 is structured so that the second heat roller 104 is immovable relative to the bearing holding member 206, whereas the first heat roller 103 is movable relative to the bearing holding member 206. This structural arrangement improves the fixing device 9 in terms of the state of contact between the external heat belt 105 and fixation roller 101. It can reduce the distance by which the external heating unit 150 has to be moved away from the fixation roller 101 to completely separate the external heat belt 105 from the fixation roller 101.

(Pressing Member)

Figure 6:
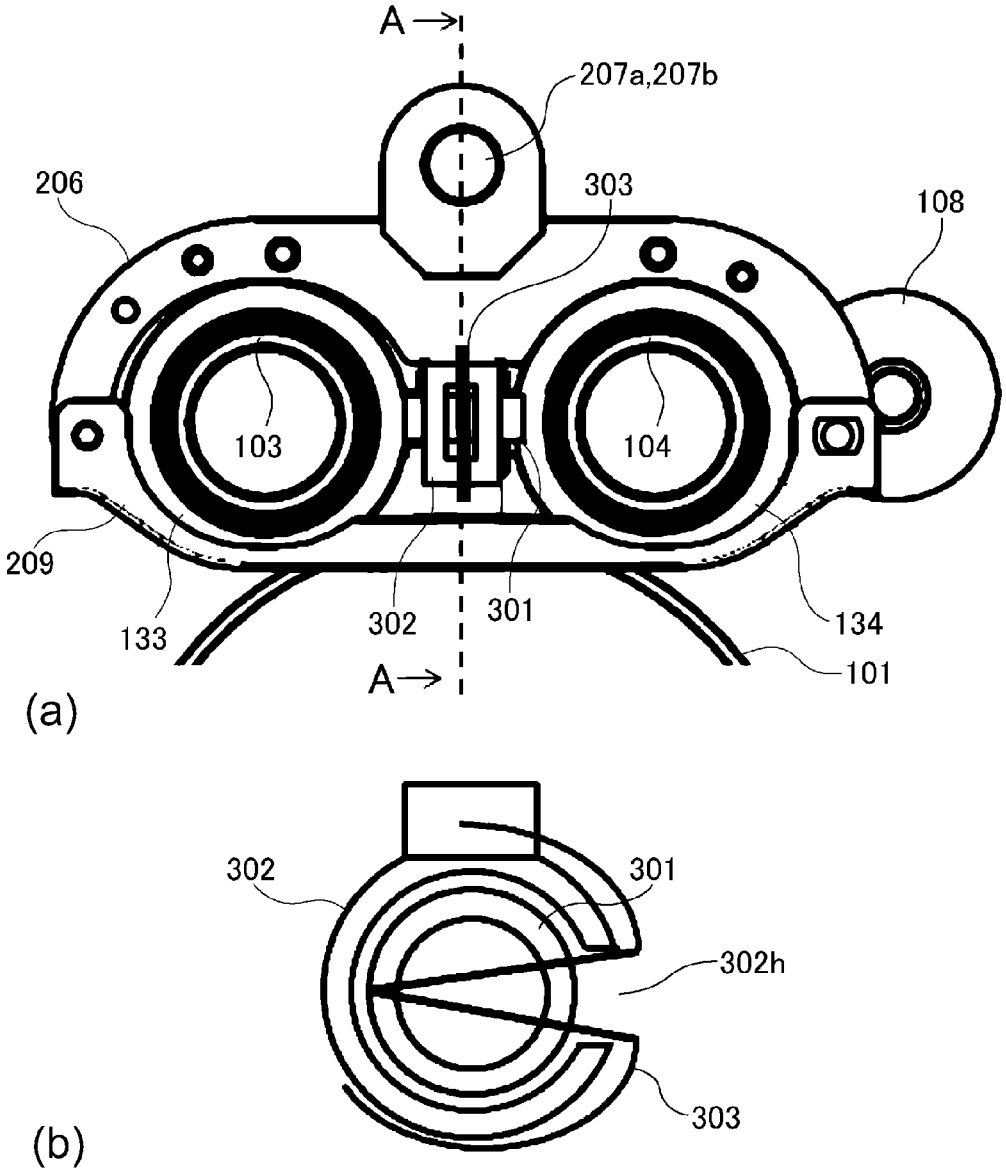
FIGS. 6(*a*) and 6(*b*) are schematic drawings for illustrating the positioning of the pressing member.

FIGS. 6(*a*) and 6(*b*) are schematic drawings for showing the positioning of the pressing member. Referring to FIGS. 6(*a*) and 6(*b*), the bearing holding member 206 is provided with the roughly cylindrical wall 302. The pressing member 301 is placed within the cylindrical wall 302, being thereby regulated in its movement in the direction perpendicular to the pressure applying direction of the pressing member 301. Further, the cylindrical wall 302 holds the pressing member 301 between the bearing 133 of the first heat roller 103 and the bearing 134 of the second heat roller 104.

Referring to FIGS. 6(*a*) and 6(*b*), the pressing member 301 is held in the cylindrical wall 302, with the use of an elastic member 303 which is made of springy steel wire, in the form of a Greek letter ω. More concretely, the central protrusive portion of the elastic member 303 is inserted into the central gap of the elastic member (coil) 303, through the hole 302*h* of the cylindrical wall 302. Thus, the pressing member 301 is regulated in its movement in its expansion (compression) direction. As the protrusive center portion of the elastic member 303 is inserter into the central gap of the elastic member 303, through the hole 302*h* of the cylindrical wall 302, the leg portions (end portions) of the elastic member 303 are made to wrap around the outward surface of the cylindrical wall 302, holding the elastic member 303 to the cylindrical wall 302. The pressing member 301 is a compression spring. In order to prevent the elastic member 303 from interfering with the expansion or compression of the pressing member 301 (compression spring) when the pressing member 303 expands or is compressed, the elastic member 303 is formed of a piece of springy wire, the diameter of which is less than the gap between the adjacent two windings of the pressing member 301 (compression spring).

First Effect of First Embodiment

Figure 7:
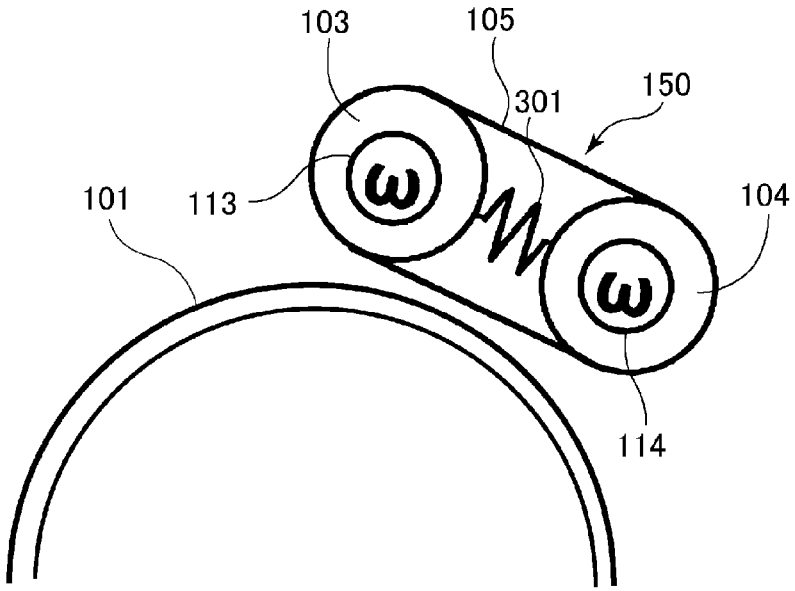
FIGS. 7(*a*) and 7(*b*) are schematic drawings for illustrating the slacking of the external heating belt.
Figure 7:
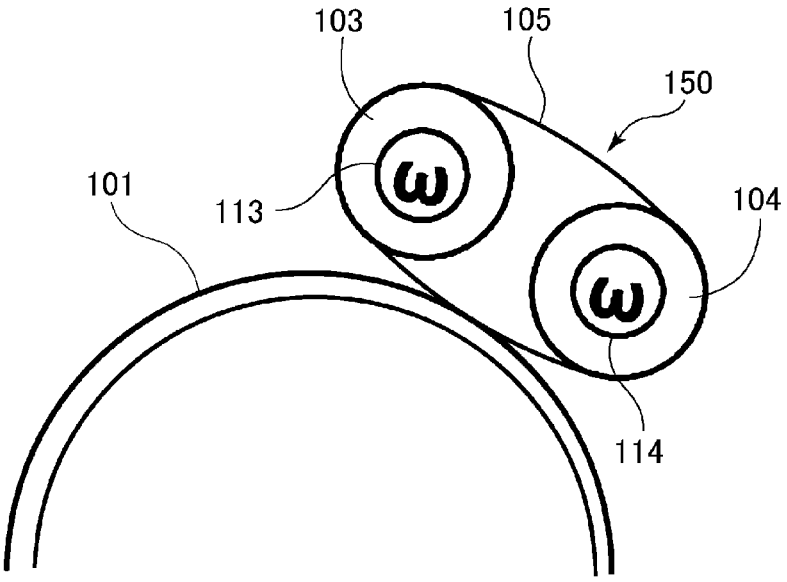

FIGS. 7(*a*) and 7(*b*) are schematic drawings for illustrating the slacking of the external heat belt 105. FIG. 7(*a*) relates to the fixing device 9 in the first embodiment 1, and FIG. 7(*b*) relates to a comparative fixing device.

Referring to FIG. 7(*a*), in the first embodiment, the external heating unit 150 is structured so that such a force is generated that acts to increase the distance between the axial line of the first heat roller 103 and the axial line of the second heat roller 104, in order to tension the external heat belt 105. Therefore, even after the external heat belt 105 is moved away from the fixation roller 101, it remains tensioned, being thereby prevented from slacking.

In the first embodiment, as the external heat belt 105 is moved away from the fixation roller 101, the pressing member 301 increases the distance between the axial line of the first heat roller 103 and the axial line of the second heat roller 104. That is, the pressing member 301 pulls the external heat belt 105 in the direction parallel to the line which is tangential to the first and second heat rollers 103 and 104, in order to tension the external heat belt 105. In this embodiment, therefore, the distance by which the external heating unit 150 has to be moved away to completely separate the external heat belt 105 from the fixation roller 101 is relatively small.

Referring to FIG. 7(*b*), the comparative external heating unit (also denoted by reference numeral 150) is not structured to generate such a force that acts to increase the distance between the first and second heat rollers 103 and 104 by which the external heat belt 105 is suspended, in order to tension the external heat belt 105. Therefore, as the external heat belt 105 is removed away from the fixation roller 101, the external heat belt 105 loses its tension, and therefore, it droops.

In the case of the comparative external heating unit (150) shown in FIG. 7(*b*), in order to increase the external heating unit (150) in the area of contact between the external heat belt 105 and fixation roller 101, the external heat belt 105 is given a preset amount of slack. Therefore, as the external heat belt 105 is moved away from the fixation roller 101, it slackens by the amount equivalent to the curvature of the fixation roller 101. Therefore, the distance by which the external heating unit (150) has to be moved away from the fixation roller 101 in order to completely separate the external heat belt 105 of the comparative external heating unit (150) from the fixation roller 101 is substantial. Further, in the case of the comparative external heating unit (150), the distance between the axial line of the first heat roller 103 and the axial line of the second heat roller 104 is not changeable. Therefore, as the external heating unit (150) is moved away from the fixation roller 101, the external heat belt 105 slackens, and therefore, it droops toward the fixation roller 101.

In the case of the comparative external heating unit (150) shown in FIG. 7(*b*), therefore, in order to completely separate the external heat belt 105 from the fixation roller 101, the distance by which the external heating unit (150) has to be moved away from the fixation roller 101 has to be substantially larger than in the case of the external heating unit 150 in this embodiment. In order to increase the distance by which the external heating unit 150 has to be moved away from the fixation roller 101, the space for allowing the external heating unit 150 to be moved away from the fixation roller 101 has to be increased in size, which in turn requires the fixing device 9 to be increased in size.

Second Effect of First Embodiment

Figure 8:
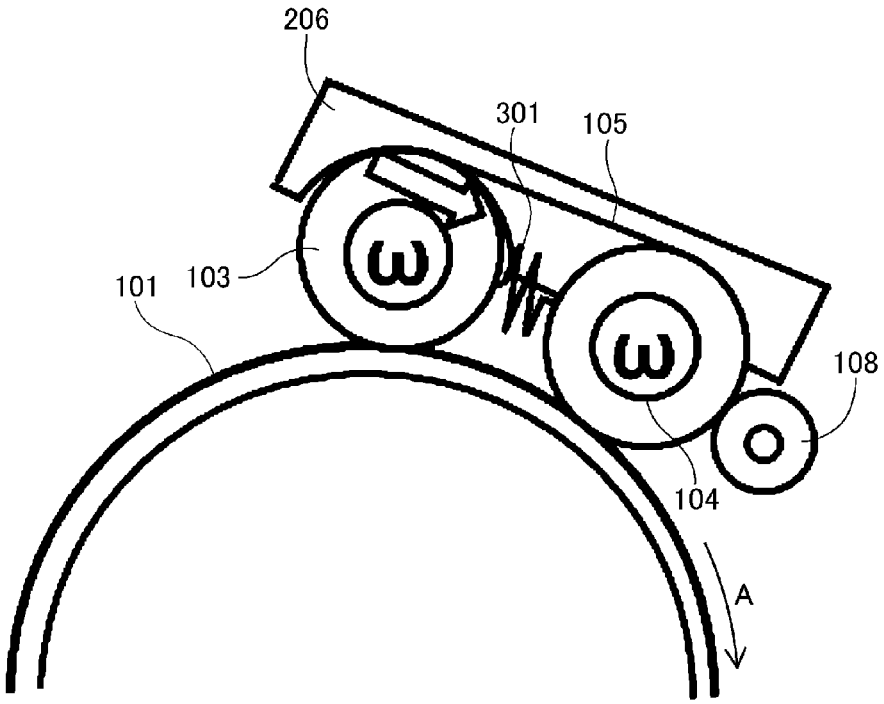
FIG. 8 is a schematic drawing for illustrating the movement of the first heat roller.

FIG. 8 is a schematic drawing for illustrating the movement of the first heat roller 103.

Referring to FIG. 8, in the first embodiment, in order to change the distance between the axial line of the first heat roller 103 and the axial line of the second heat roller 104 when the external heat belt 105 is placed in contact with, or separated from, the fixation roller 101, the first heat roller 103 is moved, whereas the second heat roller 104 is kept stationary. That is, the second heat roller 104 is fixed in position by the bearing holding member 206. Therefore, it does not move when the external heat belt 105 is placed in contact with the fixation roller 101. However, there is provided a gap between the first heat roller 103 and bearing holding member 206, in terms of the direction in which the two heat rollers 103 and 104 are aligned in parallel. Therefore, as the external heat belt 105 is placed in contact with the fixation roller 101, the first heat roller 103 is pulled by the external heat belt 105, whereby it is moved toward the second heat roller 104. Consequently, the first heat roller 103 is moved to a position in which it allows the bottom portion of the external heat belt 105, with reference to the external heat belt loop, which is between the first and second heat rollers 103 and 104, to contact the fixation roller 101 with no gap, providing a nip of a preset width. Thus, the first embodiment can improve the fixing device 9 in the state of contact between the external heat belt 105 and fixation roller 101 when the external heat belt 105 is placed in contact with the fixation roller 101.

In comparison, in the case of the second comparative external heating unit (150) shown in FIG. 7(*b*), in order to allow the distance between the axial line of the first heat roller 103 and the axial line of the second heat roller 104 to change when the external heat belt 105 is placed in contact with, or separated from, the fixation roller 101, the first heat roller 103 is not allowed to change in position, and the second heat roller 104 is allowed to change in position. Thus, as the external heat belt 105 is placed in contact with the fixation roller 101, the second heat roller 104 moves toward the first heat roller 103. In this case, the portion of the external heat belt 105, which is between the first and second heat rollers 103 and 104, changes in tension more than in the case of the fixing device 9 in the first embodiment. Therefore, it does not occur that the external heat belt 105 is placed in contact with the fixation roller 101, with no gap, across the entirety of the nip between the external heat belt 105 and fixation roller 101. Therefore, the second comparative external heating unit (150) is less desirable in terms of the state of contact between the external heat belt 105 and fixation roller 101 when the external heat belt 105 is placed in contact with the fixation roller 101.

In the case of the external heating unit 150 in the first embodiment shown in FIG. 7(*a*), even after the external heat belt 105 is moved away from the fixation roller 101 as far as it allowed to move, the external heat belt 105 does not slacken. Thus, the first embodiment can reduce the distance by which the external heat belt 105 (external heating unit 150) is to be moved away from the fixation roller 101. That is, it can reduce a fixing device in the space reserved for the movement of the external heat belt 105 (external heating unit 150). Therefore, it can reduce a fixing device in size.

In addition, the first embodiment can improve a fixing device, in particular, its replaceable external heating unit which includes the external heat belt 105, in terms of the efficiency with which the unit can be assembled, and the efficiency with which the external heat belt 105 can be replaced.

(Procedure for Assembling External Heating Unit)

Figure 9:
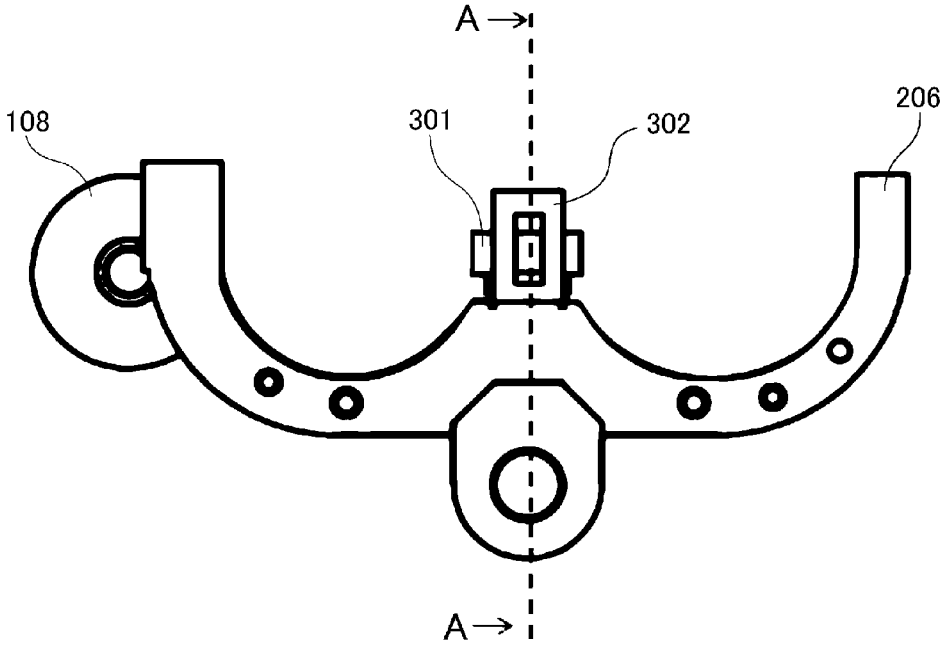
FIGS. 9(*a*) and 9(*b*) are schematic drawings for illustrating the procedure for attaching the pressing member.
Figure 9:
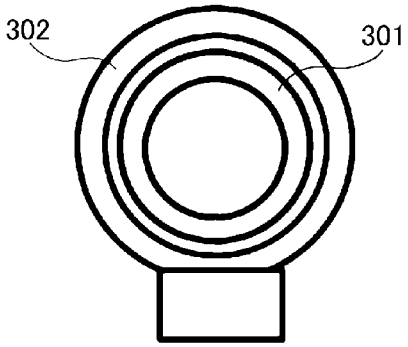
Figure 10:
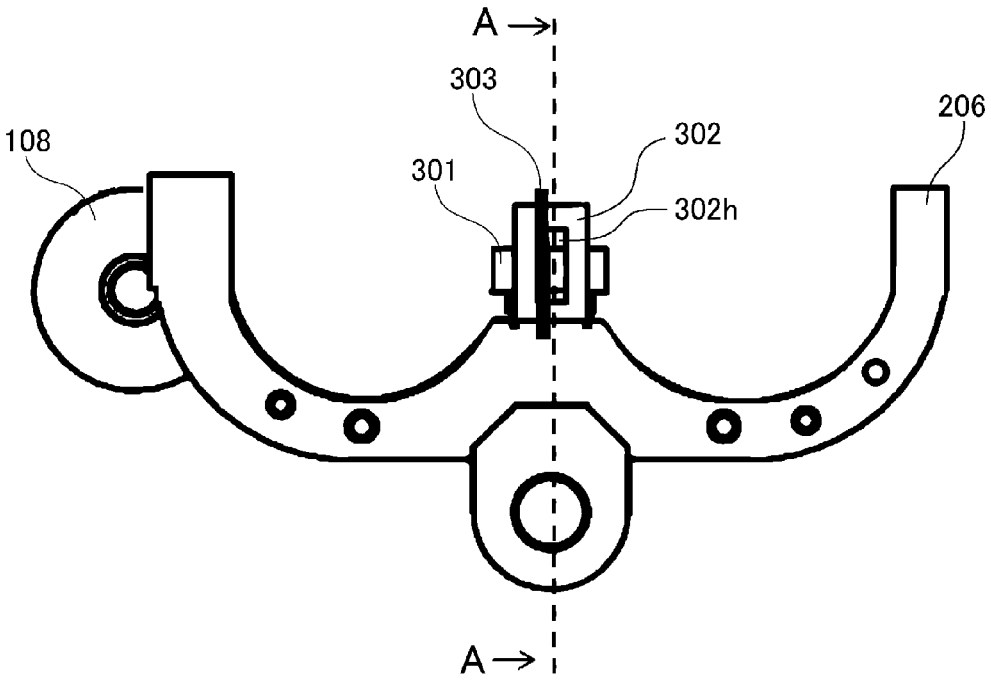
FIGS. 10(*a*) and 10(*b*) are schematic drawings for illustrating the procedure for attaching the elastic member.
Figure 10:
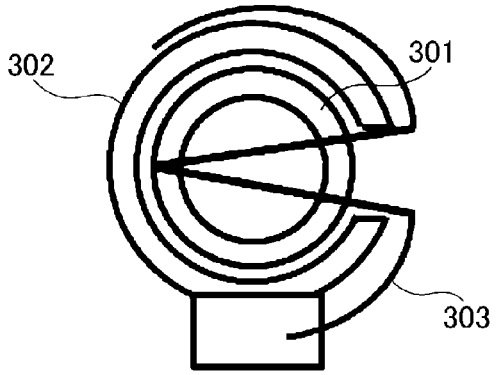
Figure 11:
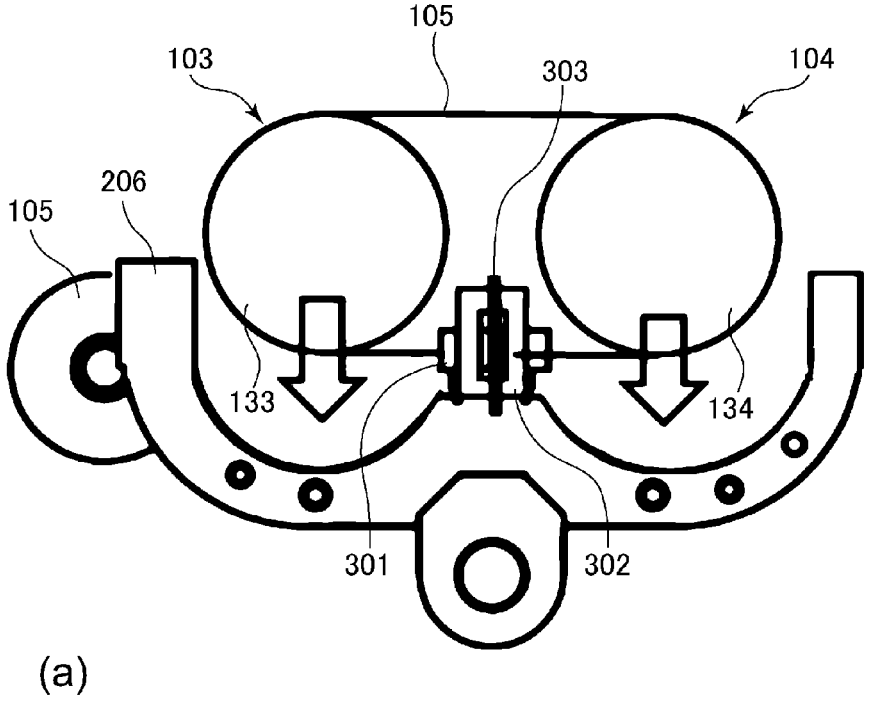
FIGS. 11(*a*) and 11(*b*) are schematic drawings for illustrating the procedure for attaching the external heating belt.
Figure 11:
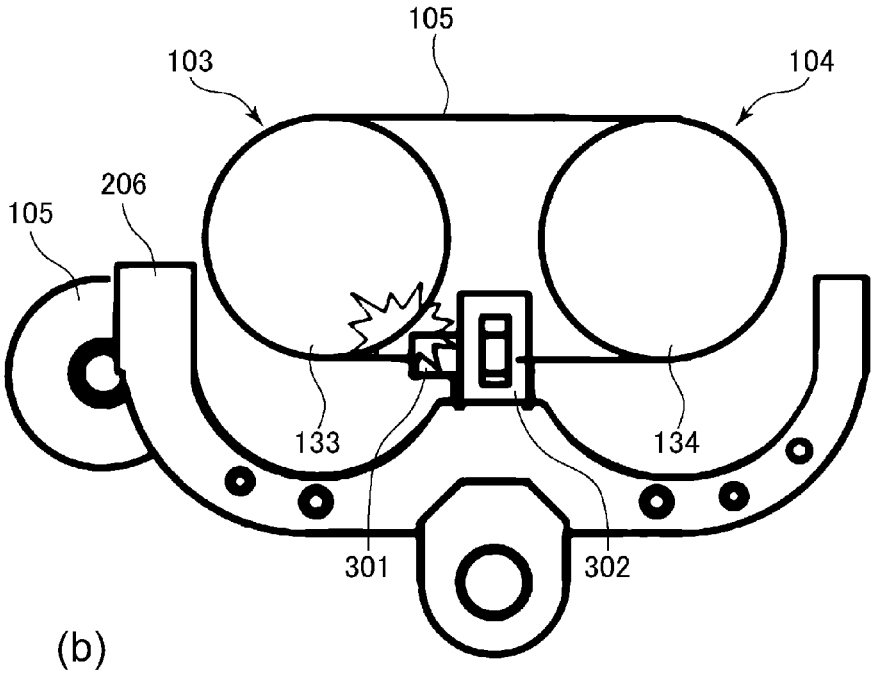

FIGS. 9(*a*) and 9(*b*) are schematic drawings for illustrating the procedure for attaching the pressing member. FIGS. 10(*a*) and 10(*b*) are schematic drawings for illustrating the procedure for attaching the elastic member. FIGS. 11(*a*) and 11(*b*) are schematic drawings for illustrating the procedure for attaching the external heat belt 105. Referring to FIGS. 5(*a*) and 5(*b*), in the case of the structure of the fixing device in the first embodiment, the pressing member 301, which presses the first and second heat rollers 103 and 104 in the direction to increase the distance between the axial line of the first heat roller 105 and the axial line of the second heat roller 104, plays an extremely important role. In this case, the pressing member 301 can be easily placed between the bearings 133 and 134, at both lengthwise ends of the two heat rollers 103 and 104.

Referring to FIGS. 9(*a*) and 9(*b*), first, the pressing member 301 is to be placed in the cylindrical wall 302 fixed to the bearing holding member 206. Therefore, both lengthwise ends of the pressing member 301 are accurately positioned. Since the pressing member 301, which is a compression spring, is held in the hollow of the cylindrical wall 302 fixed to the bearing holding member 206, it is allowed to freely expand or be compressed. Further, it does not fall out of the cylindrical wall 203 even if the bearing holding member 206 is held upside down.

Referring to FIGS. 10(*a*) and 10(*b*), next, the pressing member 301 is to be positioned so that its center, in terms of its expansion (compression) direction, coincides with the center of the cylindrical wall 302. Then, the elastic member 303 is to be attached to the cylindrical wall 302 in such a manner that its protrusive center portion fits into the hole 302*h* of the cylindrical wall 302, and its leg portions (lengthwise end portions) wrap around the outward surface of the cylindrical wall 302. During this procedure, the protrusive central portion of the elastic member 303 fits into one of the gaps of the coil portion of the pressing member 301, preventing thereby the pressing member 301 from shifting in the expansion (compression) direction of the pressing member 301.

Referring to FIG. 11(*a*), next, the first and second heat rollers 103 and 104 are to be placed on the inward side of the external heat belt 105, and the lengthwise ends of the first and second heat rollers 103 and 104 are to be fitted with the two pairs of bearings 133 and 134, one for one. Then, the bearing holding member 206 is to be attached to the assembly of the external heat belt 105, the first heat roller 103, the second heat roller 104, the bearings 133, and the bearings 134, from above the assembly.

In the first embodiment, the pressing member 301 is placed in the cylindrical wall 302 with which the bearing holding member 206 is provided. Further, it is regulated in position by the elastic member 303. Therefore, even if the bearings 133 and 134 come into contact with the pressing member 301 when the first and second heat rollers 103 and 104 are attached to the bearing holding member 206 after being placed on the inward side of the external heat belt 105, it does not occur that the pressing member 301 substantially changes in position. Thus, the structural arrangement of the fixing device 9 (external heating unit 150) in the first embodiment makes it easier the operation for attaching the first and second heat rollers 103 and 104 to the bearing holding member 206 after their placement on the inward side of the external heat belt 105.

In the first embodiment, the pressing member 301 and the elastic member 303 were left attached to the cylindrical wall 302 to simplify the operation for replacing the external heat belt 105. However, the elastic member 303 may be removed and stored after the completion of the assembly of the external heating unit 150. The removed elastic member 303 may be reattached to replace the external heat belt 105, etc., next time.

Referring to FIG. 11(*b*), in the case of the third comparative external heating unit (also denoted by reference numeral (150), although this reference numeral is not shown in FIG. 11(*b*)), the pressing member 301 is not regulated in position in terms of its compression (expansion) direction. Therefore, it is possible that when the assembly of the external heat belt 105, the first heat roller 103, the second heat roller 104, etc., is attached to the bearing holding member 206 from the top side of the bearing holding member 206, the pressing member 301 will be displaced in its compression (expansion) direction at the moment of the contact between the pressing member 301, and the bearings 133 and/or 134. Therefore, it is possible that the pressing member 301 will fall out of the cylindrical wall 302, and then, will slip into the underside of the first heat roller 103 or second heat roller 104. In other words, it is possible that the pressing member 301 will be lost when the external heating unit (150) shown in FIG. 11(*b*) is assembled. In other words, the third comparative external heating unit (150) shown in FIG. 11(*b*) is very difficult to assemble.

Third Effect of First Embodiment

In the first embodiment, the pressing member 301 is provided to keep the first and second heat rollers 103 and 104 pressed in the direction to increase the distance between the axial line of the first heat roller 103 and the axial line of the second heat roller 104. Further, the first heat roller 103, or the upstream heat roller, is enabled to shift in position. Therefore, as the external heat belt 105 is moved away from the fixation roller 101, the external heat belt 105 is tensioned by the shifting of the first heat roller 103; the external heat belt 105 is prevented from slacking. In other words, the first embodiment can prevent the problem that as the external heat belt 105 is moved away from the fixation roller 101, the external heat belt 105 slackens. Therefore, it can reduce the distance by which the external heat belt 105 has to be moved away from the fixation roller 101.

Also in the first embodiment, the external heating unit 150 is provided with the cylindrical wall 302 which is for holding the pressing member 301 (compression spring) between the first and second heat rollers 103 and 104 in such a manner that the pressing member 301 is allowed to freely expand or be compressed, and also, for preventing the pressing member 301 from falling out of the external heating unit 150 in the direction perpendicular to the direction in which the first and second heat rollers 103 and 104 are pressed to tension the external heat belt 105. Further, the external heating unit 150 is provided with the spring which is shaped like a Greek letter ω, and is for preventing the pressing member 301 from slipping out of the cylindrical wall 302. Therefore, the pressing member 301 is automatically adjusted in position so that the pressing member 301 can properly press the first heat roller 103. Therefore, the first embodiment can improve a fixing device in ease and efficiency with which a fixing device can be assembled, and/or the components of the fixing device can be replaced.

The first embodiment makes it possible for an image forming apparatus, such as a copying machine, a printer, a multifunction image forming apparatus, and the like, to be increased in speed, improved in image quality, be colorized, and also, be reduced in energy consumption. Further, the first embodiment can enable an image forming apparatus to deal with various recording media such as cardstock, rough paper, embossed paper, coated paper, etc., and also, can improve an image forming apparatus in productivity (print output count per unit length of time).

Also in the first embodiment, the external heat belt 105 is employed to assist the heating of the fixation roller 101. Therefore, it is not necessary that in order to ensure that the fixing device remains satisfactory in fixation (adhesion between toner and recording medium), the fixing device is reduced in recording medium conveyance speed. In other words, the first embodiment can solve one of the problems of the conventional technology for improving a fixing device in the amount of the heat supply to the fixation roller 101.

In the first embodiment, the fixing device 9 was structured so that the fixation belt 101 is supplied with an auxiliary amount of heat by the external heat belt 105. Further, it is structured so that the two heat rollers, by which the external heat belt 105 is suspended, are kept pressed in the direction to tension the external heat belt 105, and also, so that one of the two heat rollers can be shifted in position. Therefore, it is possible to prevent the problem that as the external heat belt 105 is moved away from the fixation roller 101, it slackens.

Therefore, it is possible to reduce the distance by which the external heat belt 105 has to be separated from the fixation roller 101, and also, it is possible to improve a fixing device in the state of contact between the fixation roller 101 and external heat belt 105 in terms of the presence of gap between the fixation roller 101 and external heat belt 105. Further, it is possible to improve a fixing device in ease and efficiency with which a fixing device can be assembled, and the components of the fixing device can be replaced.

Embodiment 2

Figure 12:
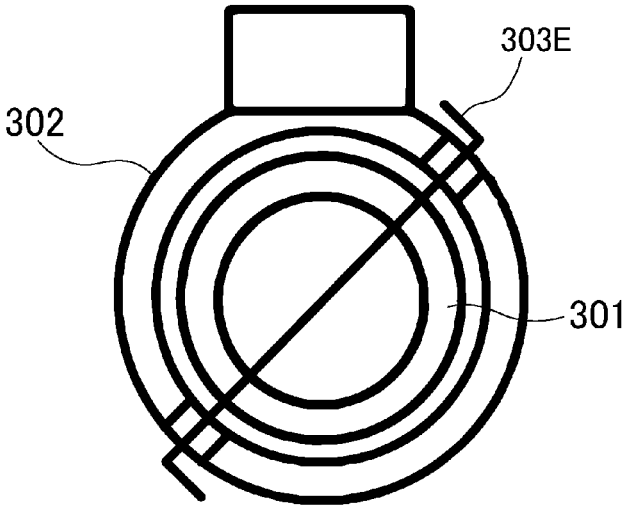
FIG. 12 is a schematic drawing for illustrating the elastic member in the second embodiment of the present invention.

FIG. 12 is a schematic drawing for illustrating the elastic member in the second embodiment of the present invention. Referring to FIG. 12, the elastic member 203, which is for positioning the pressing member 301 relative to the cylindrical wall 302, does not need to be in the form of a ring such as the one in the first embodiment, which is in the form of a Greek letter ω. That is, it may be replaced with a pin, a twist, a C-ring, or the like.

The present invention partially or entirely encompasses embodiments other than those described above, as long as the embodiments provide a belt suspended by the first and second rollers, with a necessary amount of tension, by the placement of an elastic member between the bearing of the first roller, and the bearing of the second roller.

That is, the heating device for heating a rotational member (roller or belt) does not need to be limited to a halogen heater. For example, the rotational member or belt may be provided with a layer which is inductively heatable by an alternating magnetic flux. Further, the application of the present invention is not limited to a heating member, in the form of an endless belt, which is for heating a rotational member. That is, the present invention is also applicable to a device for making a rotational member uniform in temperature in terms of the direction parallel to the rotational axis of the rotational member, and also, a device for increasing the speed with which a rotational member can be cooled. Further, the rotational member does not need to be the fixation roller. For example, it may be a pressure roller for heating a sheet of recording medium from the opposite side of the sheet from the side on which an image is present.

An image heating device includes heating devices other than a fixing device. For example, it includes a surface heating device for adjusting an incompletely fixed image or a completely fixed image in surface properties such as glossiness, and also, a device for flattening a sheet of recording medium, such a curled sheet of recording medium on which a fixed image is present.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 025456/2013 filed Feb. 13, 2013, which is hereby incorporated by reference.

What is claimed is:

1. An image heating apparatus comprising:

first and second rotatable members configured and positioned to form a nip for heating therein a toner image on a sheet;

an endless belt configured to contact an outer surface of said first rotatable member and heat said first rotatable member;

first and second rollers provided inside said endless belt and to rotatably support said endless belt;

first and second bearings configured to rotatably support said first and second rollers;

an elastic member contactable to said first bearing and to said second bearing and configured and positioned to urge said first roller and said second roller in directions away from each other; and a preventing member configured and positioned to prevent said elastic member from moving in directions of expansion and contraction thereof when said elastic member is out of contact with said first bearing and said second bearing.

2. An apparatus according to claim 1, further comprising a guiding member configured and positioned to guide the expansion and contraction of said elastic member, wherein said elastic member is fixed to said guiding member by said preventing member.

3. An apparatus according to claim 2, wherein said elastic member includes a coil spring, and said preventing member includes a spring wire.

4. An apparatus according to claim 1, further comprising: third and fourth bearings configured to rotatably support said first and second rollers, respectively; another elastic member contactable to said third bearing and to said fourth bearing and configured and positioned to urge said first roller and said second roller in directions away from each other; and another preventing member configured and positioned to prevent said another elastic member from moving in directions of expansion and contraction thereof when said another elastic member is out of contact with said third bearing and said fourth bearing.

5. An apparatus according to claim 4, further comprising another guiding member configured and positioned to guide the expansion and contraction of said another elastic member, wherein said another elastic member is fixed to said another guiding member by said another preventing member.

6. An apparatus according to claim 5, wherein said another elastic member includes another coil spring, and said another preventing member includes another spring wire.

7. An apparatus according to claim 1, wherein said first rotatable member is contactable to the toner image which is unfixed.

8. An apparatus according to claim 1, wherein said first roller and said second roller are provided with respective heaters.

9. An apparatus according to claim 1, further comprising a moving mechanism configured and positioned to contact and space said endless belt relative to said first rotatable member.

10. An image heating apparatus comprising:

first and second rotatable members configured and positioned to form a nip for heating therein a toner image on a sheet;

an endless belt configured to contact an outer surface of said first rotatable member and heat said first rotatable member;

first and second rollers provided inside said endless belt and to rotatably support said endless belt;

first and second bearings configured to rotatably support said first and second rollers;

a holder configured to hold said first bearing and said second bearing;

a coil spring configured and positioned to urge said first roller and said second roller in directions away from each other, said coil spring having one end portion, with respect to expansion and contracting directions, which is contactable with said first bearing, and the other end portion which is contactable with said second bearing; and a fixing member configured to fix, to said holder, a portion which is between said one end portion and the other end portion.

11. An apparatus according to claim 10, wherein said holder is provided with a guide portion configured and positioned to guide the expansion and contraction of said coil spring, and wherein said fixing member fixes said coil spring to said guide portion.

12. An apparatus according to claim 11, wherein said fixing member includes a wire spring.

13. An apparatus according to claim 10, further comprising: third and fourth bearings configured to rotatably support said first and second rollers, respectively; another holder configured to hold said third bearing and said fourth bearing; another coil spring configured and positioned to urge said first roller and said second roller in directions away from each other, said another coil spring having one end portion, with respect to expansion and contracting directions thereof, which is contactable with said third bearing, and another end portion which is contactable with said fourth bearing; and another fixing member configured to fix, to said another holder, a portion which is between said one end portion and the other end portion of said another coil spring.

14. An apparatus according to claim 13, wherein said another holder is provided with another guide portion configured and positioned to guide the expansion and contraction of said another coil spring, and said another fixing member fixes said another coil spring to said another guide portion.

15. An apparatus according to claim 14, wherein said another fixing member includes a wire spring.

16. An apparatus according to claim 10, wherein said first rotatable member is contactable to the toner image which is unfixed.

17. An apparatus according to claim 10, wherein said first roller and said second roller are provided with respective heaters.

18. An apparatus according to claim 10, further comprising a moving mechanism configured and positioned to contact and space said endless belt relative to said first rotatable member.

* * * * *